US009490585B2

(12) United States Patent
Yang

(10) Patent No.: US 9,490,585 B2
(45) Date of Patent: Nov. 8, 2016

(54) ELECTRICAL CONNECTOR WITH IMPRIVED GROUNDING BAR

(71) Applicant: FOXCONN INTERCONNECT TECHNOLOGY LIMITED, Grand Cayman (KY)

(72) Inventor: Wen-Hui Yang, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/804,268

(22) Filed: Jul. 20, 2015

(65) Prior Publication Data

US 2016/0020558 A1 Jan. 21, 2016

(30) Foreign Application Priority Data

Jul. 21, 2014 (TW) ..... 103213006 U

(51) Int. Cl.
*H01R 4/66* (2006.01)
*H01R 13/6585* (2011.01)
*H01R 12/72* (2011.01)

(52) U.S. Cl.
CPC ..... *H01R 13/6585* (2013.01); *H01R 12/724* (2013.01)

(58) Field of Classification Search
CPC ..... H01R 23/7073; H01R 12/57; H01R 13/65802; H01R 4/646; H01R 23/688; H01R 13/2442
USPC ..... 439/79, 83, 95, 98, 108, 607.05, 439/607.07, 607.08, 626, 660
See application file for complete search history.

(56) References Cited

U.S. PATENT DOCUMENTS 7,485,009 B1 * 2/2009 Zhu ..... H01R 23/6873 439/444
7,909,652 B2 * 3/2011 Yang ..... H01R 12/714 439/660
8,202,127 B2 * 6/2012 Zhang ..... H01R 24/60 439/660
8,342,886 B2 * 1/2013 Zhang ..... H01R 12/7005 439/660
8,353,726 B2 * 1/2013 Zhang ..... H01R 12/721 439/629
8,585,440 B2 * 11/2013 Jiang ..... H01R 13/6477 439/626
8,694,709 B2 * 4/2014 Loffink ..... H01R 13/70 361/679.33
8,702,451 B2 * 4/2014 Luo ..... H01R 12/725 439/607.28
8,858,243 B2 * 10/2014 Luo ..... H01R 13/652 439/108
8,944,849 B1 * 2/2015 Yang ..... H01R 13/6588 439/607.07

FOREIGN PATENT DOCUMENTS

CN 103515792 1/2014

* cited by examiner

*Primary Examiner* — Thanh Tam Le
(74) *Attorney, Agent, or Firm* — Wei Te Chung; Ming Chieh Chang

(57) ABSTRACT

An electrical connector includes an insultive housing and defining a base seat and a mating portion extending from the base seat. A plurality of conductive terminals are retained in the mating portion and include a plurality of differential signal terminal pairs and grounding terminals, each conductive terminal defines a contacting portion disposed on the mating portion, a retaining portion fixed to the base seat and a connecting portion extending outside of the base seat, the contacting portion of each grounding terminal has a free end extending toward the inside of the mating portion and abutting against a first grounding bar. A second grounding bar defines a base portion and a plurality of abutting portions extending from the base portion and abutting against the retaining portions of the grounding terminals. The first grounding bar and the second grounding bar are connected by a bridging portion thereof.

17 Claims, 6 Drawing Sheets

ELECTRICAL CONNECTOR WITH IMPRIVED GROUNDING BAR

BACKGROUND OF THE INVENTION

1. Field of the Invention

The present invention relates to an electrical connector, and more particularly to an electrical connector used for high frequency transmission.

2. Description of the Related Art

Chinese Patent Application No. 103515792A published on Jan. 15, 2014, discloses an electrical connector including an insulative housing and a plurality of conductive terminals retained in the insulative housing. The insulative housing defines a base portion, a tongue portion extending forwardly from the base portion and a plurality of terminal slots formed on the tongue portion, the tongue portion defines at least one mating surface. The conductive terminal defines a retaining portion retained in the insulative housing and a contacting portion disposed on the tongue portion. The conductive terminals includes a plurality of differential signal terminal pairs and grounding terminals, the grounding terminals are arranged on both sides of each differential signal terminal pairs. The retaining portions of the grounding terminals are electrically connected to each other and the contacting portions of the grounding terminals are also electrically connected to each other. The electrical connector has a good high-frequency transmission performance when the transmission rate is 12 Gbps. However, when the transmission rate is up to 24 Gbps, signal crosstalk phenomenon is more obvious which seriously affecting the quality of the high-frequency signal transmission.

Therefore, an improved electrical connector is highly desired to meet overcome the requirement.

BRIEF SUMMARY OF THE INVENTION

An object of the present invention is to provide an electrical connector having good high frequency transmission performance.

In order to achieve above-mentioned object, an electrical connector includes an insultive housing extending along a longitudinal direction and defining a base seat and a mating portion extending from the base seat along a mating direction perpendicular to the longitudinal direction, the mating portion defines a mating surface and a plurality of terminal slots recessed on the mating surface. A plurality of conductive terminals are retained in the terminal slots and include a plurality of differential signal terminal pairs and a plurality of grounding terminals located between the plurality of differential signal terminal pairs, each conductive terminal defines a contacting portion disposed on the mating surface, a retaining portion fixed to the base seat and a connecting portion extending outside of the base seat, the contacting portion of each grounding terminal has a free end extending toward the inside of the mating portion. A first grounding bar is facing to the contacting portions of the conductive terminals, and the free ends of the grounding terminals are abutting against the first grounding bar. And a second grounding bar is facing to the retaining portions of the conductive terminals and defines a base portion and a plurality of abutting portions extending from the base portion and abutting against the retaining portions of the grounding terminals. The first grounding bar and the second grounding bar are connected by a bridging portion thereof.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
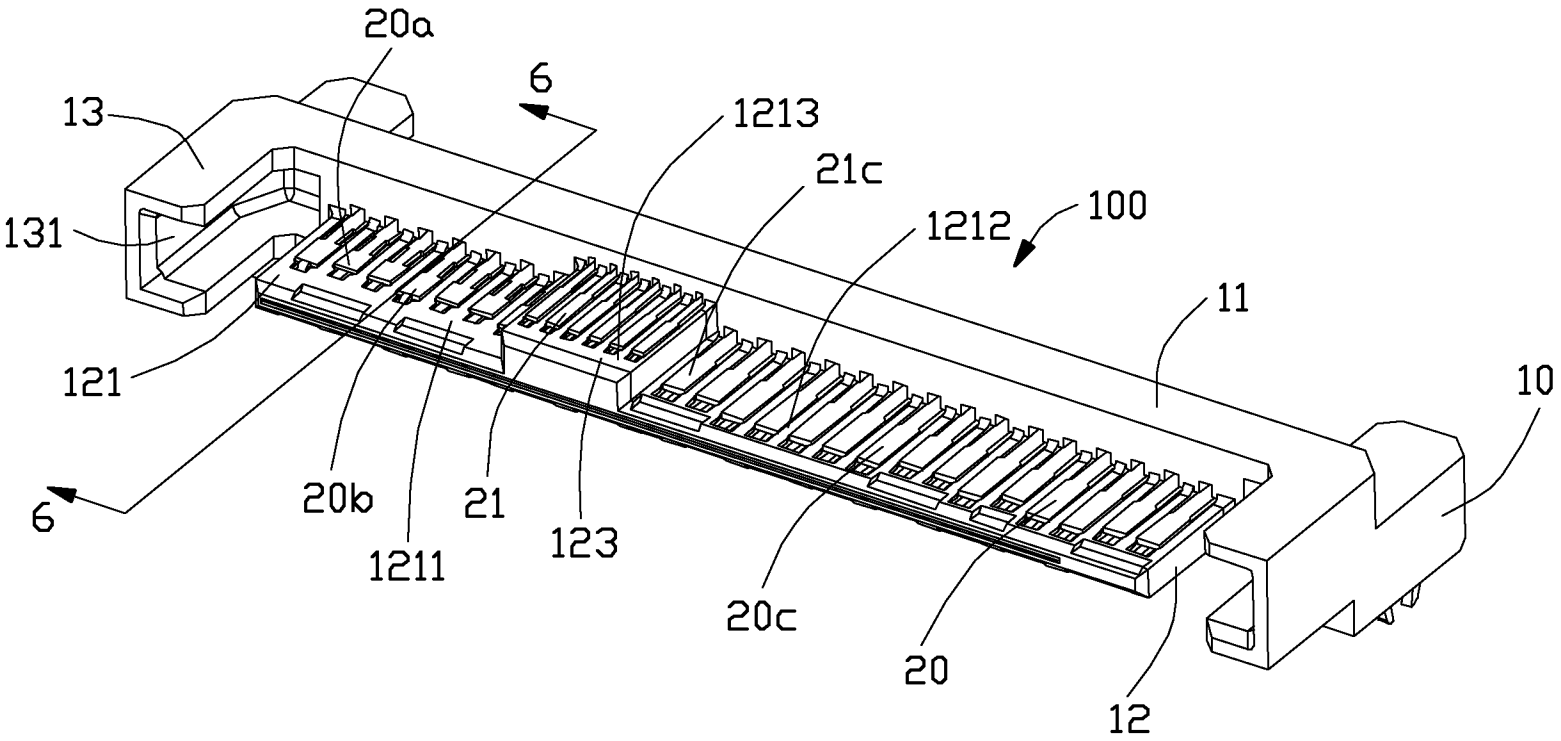
FIG. 1 is a perspective view of an electrical connector in accordance with the present invention.
Figure 2:
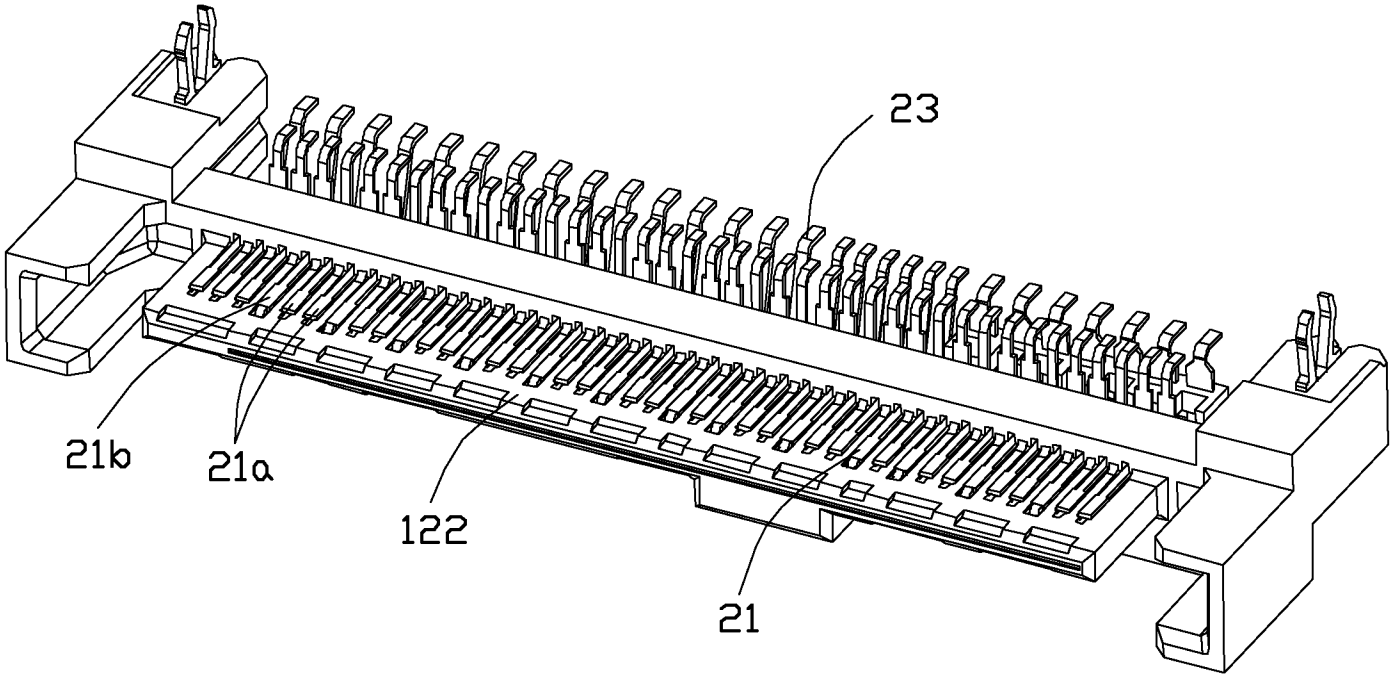
FIG. 2 is another perspective view of the electrical connector shown in FIG. 1.

Reference will now be made to the drawing figures to describe a preferred embodiment of the present invention in detail. Referring to FIG. 1 to FIG. 2, an electrical connector 100 is soldered on a printed circuit board or connected to a cable. The electrical connector 100 includes an elongated insulative housing 10 extending along a longitudinal direction and a plurality of conductive terminals 20 retained in the insulative housing 10. The insulative housing 10 defines a base seat 11, a mating portion 12 extending forwardly from the base seat 11 along a mating direction perpendicular to the longitudinal direction and a pair of guiding portions 13 extending from both sides of the mating portion 12. The guiding portion 13 defines a guiding slot 131 facing to the side of the mating portion 11 and used for guiding a mating connector.

The mating portion 12 defines a first surface 121 and a second surface 122 opposite to each other, and a convex portion 123 projecting from the first surface 121. The first surface 121 is divided into a first mating surface 1211, a second mating surface 1212 and a third mating surface 1213 formed on the convex portion 123, the second surface 122 is defined as a forth mating surface.

Each conductive terminal 20 defines a contacting portion 21 disposed on said mating surface, a retaining portion 22 fixed to the base seat 11 and a connecting portion 23 projecting outside of the base seat 11. The retaining portion 22 is connecting the contacting portion 21 and the connecting portion 23, and the connecting portion 23 is used to secure to a circuit board or a cable by soldering or otherwise.

The conductive terminals 20 are divided into a plurality of differential signal terminal 20*a*, grounding terminals 20*b* and power terminals 20*c* according to the signal transmission. The contacting portions 21*c* of the power terminals 20*c* are disposed on the second mating surface 1212, the contacting portions 21*c* of the differential signal terminal 20*a* and the contacting portions 21*c* of the grounding terminals 20*b* are disposed on the first mating surface 1211, the third mating surface 1213 and the fourth mating surface 122. The differential signal terminals 20*a* are arranged in pairs, each pair of the differential signal terminals 20*a* are located between two ground terminals 20*b* in order to prevent crosstalk between each pair of differential signal terminals.

Figure 4:
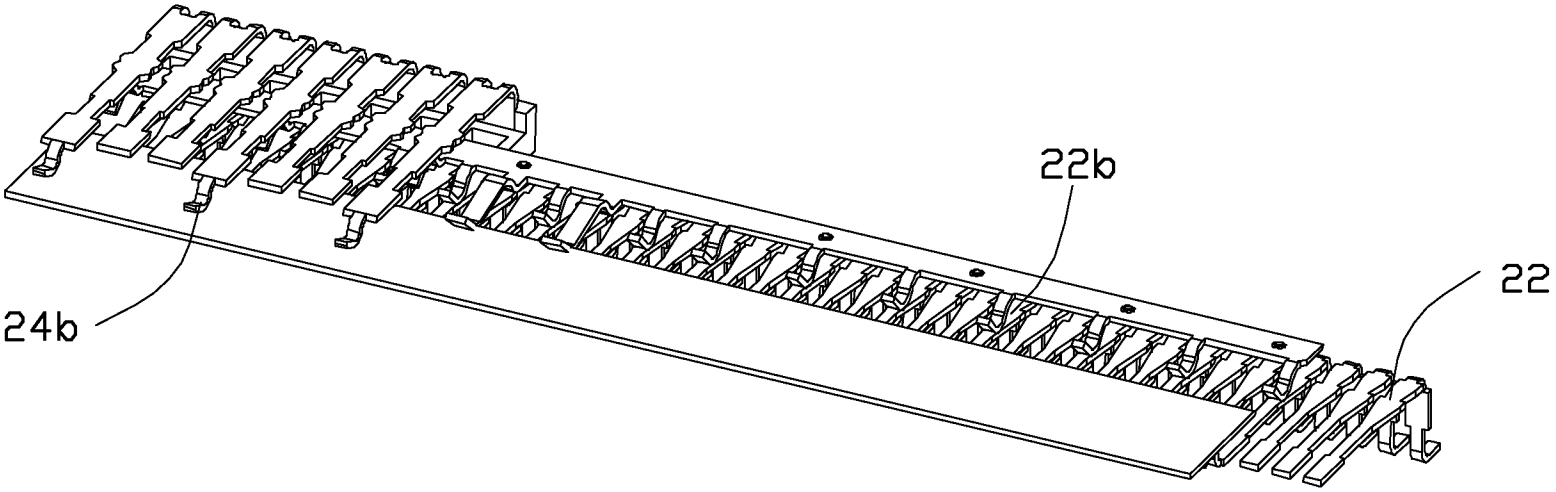
FIG. 4 is a perspective view of the first and second grounding bars mating the conductive terminals shown in FIG. 3, wherein the power terminals are not shown.
Figure 5:
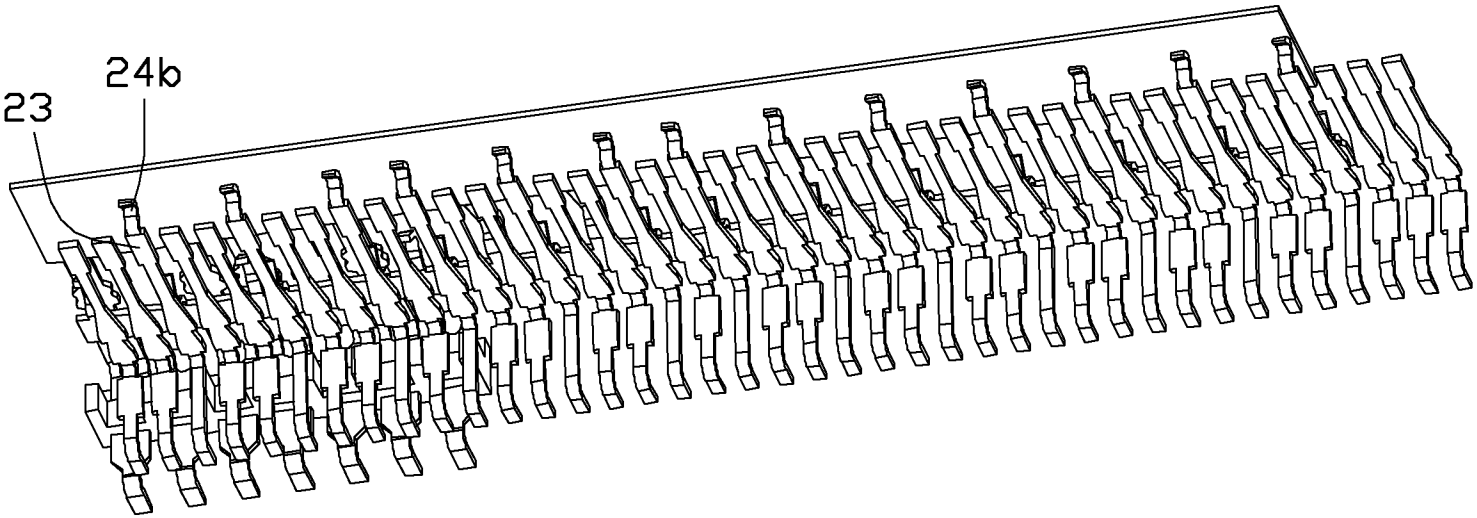
FIG. 5 is another perspective view of the first and second grounding bars mating the conductive terminals shown in FIG. 4.
Figure 6:
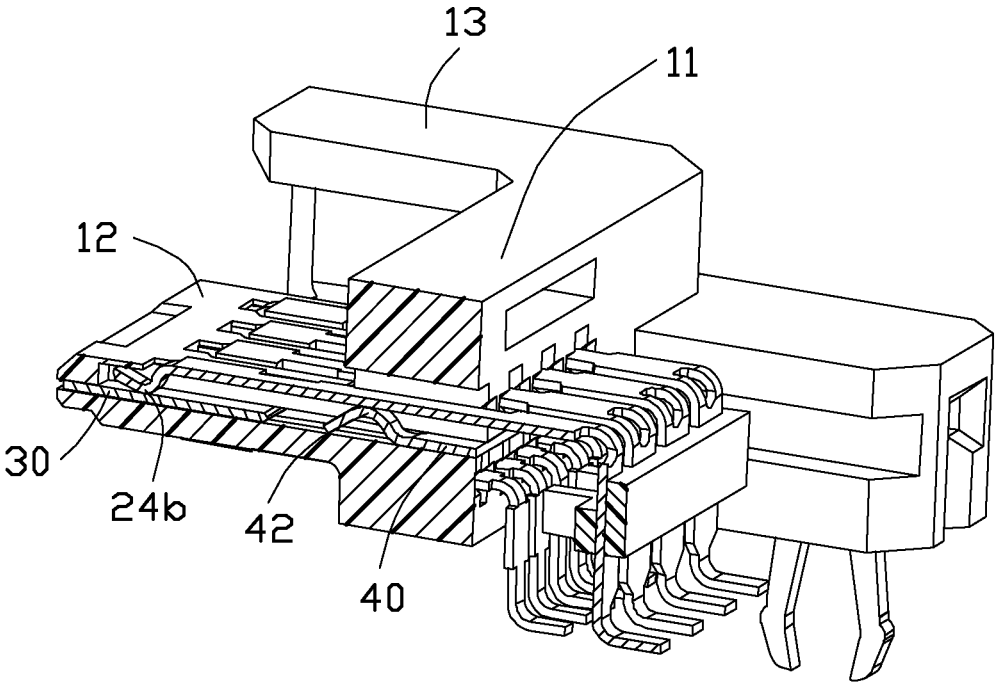
FIG. 6 is a cross-sectional perspective view of the electrical connector shown in FIG. 1.

Referring to FIG. 4 to FIG. 6, the electrical connector 100 defines a first grounding bar 30 disposed in the mating portion 12 of the insulative housing 1 and a second grounding bar 40 disposed in the base seat 11 of the insulative housing 10. The first grounding bar 30 extending along the longitudinal direction and rearwardly assembled into a first middle slot of the mating portion 12 from a front side of the housing 10, and the second grounding bar 40 extending along the longitudinal direction and forwardly assembled into a second middle slot of the base seat 11 from a rear side of the housing 10. In other embodiment, the first and second grounding bars can also be injection molded in the insulative housing 10. The first grounding bar 30 and the second grounding bar 40 are arranged along the longitudinal direction in order that the first grounding bar 30 is facing the contacting portions 21 of the conductive terminals 20 and the second grounding bar 40 is facing the retaining portion 22 of the conductive terminals 20. The contacting portion of each grounding terminal 20*b* defines a free end 24*b* extending toward the first grounding bar 30 in front side thereof, the free end 24*b* is abutting against the first grounding bar 30 so as to form electrical connection.

Figure 3:
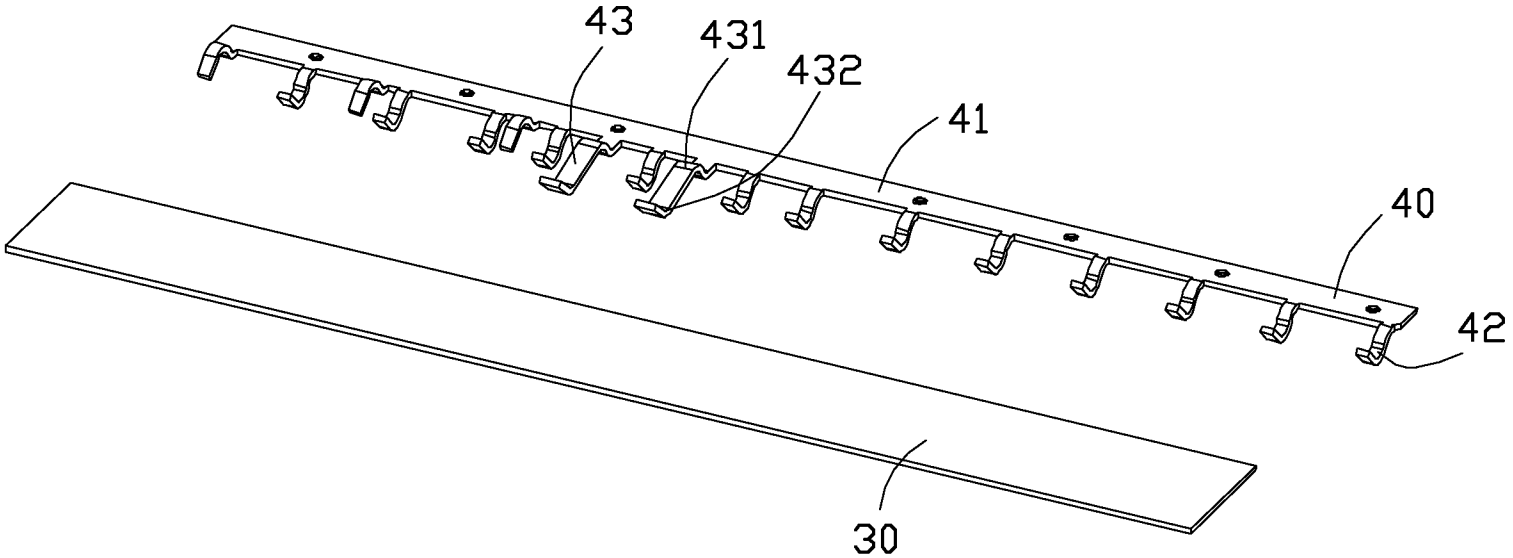
FIG. 3 is a perspective view of a first grounding bar and a second grounding bar of the electrical connector shown in FIG. 1.

Referring to FIG. 3, the first grounding bar 30 is a flat plate, the second grounding bar 40 defines a longitudinal base portion 41, a plurality of resilient abutting portions 42 and resilient bridging portions 43 extending from the base portion 41. In present embodiment, the abutting portions 42 and the bridging portions 43 are extending toward the first grounding bar 30 and substantially parallel, each bridging portion 43 is located between two abutting portions 42. The abutting portion 42 is extending toward the retaining portion of the grounding terminal 20*b* and abutted against the corresponding retaining portion of the grounding terminal 20*b* so that the grounding terminals 20*b* are electrically connected to the second grounding bar 40.

The first grounding bar 30 and the second grounding bar 40 are connected to each other by at least one bridging portion 43, which is eliminating the potential difference between the first grounding bar 30 and the second grounding bar 40 so that the potential difference between the connecting portions and the retaining portions of the grounding terminals is close to zero potential, thereby improving the performance of the high-frequency transmission and obtaining good transmission quality. The number of the bridging portion 43 is preferred two in present embodiment, considering the size of the bridging portion 43 and the manufacturing difficulty of the electrical connector. The bridge portion 43 is substantially horizontal "S" shape and includes a first arcuate portion 431 opening downwardly and a second arcuate portion 432 opening upwardly in order to obtain good flexibility and increase retention. The first arcuate portion 431 is extending from the base portion 41 and the second arcuate portion 432 is extending from the first arcuate portion 431 and abutting against the first grounding bar 30.

It is worth noting that, the bridging portion 43 extends only toward the first grounding bar 30 and need to be connected to the first grounding bar 30 so that the first grounding bar 30 and the second grounding bar 40 are electrically connected to each other. And the abutting portions 42 are not necessarily face the first grounding bar 30, depending on the relative position between the conductive terminals 20 and the second grounding bar 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising:

an insulative housing extending along a longitudinal direction and defining a base seat and a mating portion extending from the base seat along a mating direction perpendicular to the longitudinal direction, the mating portion defining a mating surface and a plurality of terminal slots recessed on the mating surface;

a plurality of conductive terminals retained in the terminal slots and comprising a plurality of differential signal terminal pairs and a plurality of grounding terminals located between the plurality of differential signal terminal pairs, each conductive terminal defining a contacting portion disposed on the mating surface, a retaining portion fixed to the base seat and a connecting portion extending outside of the base seat, the contacting portion of each grounding terminal having a free end extending toward the inside of the mating portion;

a first grounding bar facing to the contacting portions of the conductive terminals, and free ends of the grounding terminals abutting against the first grounding bar; and a second grounding bar facing to the retaining portions of the conductive terminals and defining a base portion and a plurality of abutting portions extending from the base portion and abutting against the retaining portions of the grounding terminals; wherein the first grounding bar and the second grounding bar are connected by a bridging portion thereof, the bridging portion defines a first arcuate portion and a second arcuate portion connected to each other and extending in an opposite manner in a vertical direction, and a free end of the second arcuate portion abuts against the first grounding bar.

2. The electrical connector as described in claim 1, wherein the bridging portion is extending integrally from the second grounding bar.

3. The electrical connector as described in claim 2, wherein the bridging portion is located between two abutting portions.

4. The electrical connector as described in claim 1, wherein the first grounding bar and the second grounding bar are connected by at least two said bridging portions thereof.

5. The electrical connector as described in claim 1, wherein the first and second grounding bars are injection molded in the insulative housing.

6. The electrical connector as described in claim 1, wherein the abutting portions of the second grounding bar are extending toward the first grounding bar.

7. The electrical connector as described in claim 6, wherein the first grounding bar and the base portion of the second grounding bar are disposed on a same plane.

8. An electrical connector, comprising:

an insulative housing extending along a longitudinal direction and defining a base seat and a mating portion extending from the base seat along a mating direction perpendicular to the longitudinal direction, the mating portion defining opposite a first surface and a second surface and a convex portion projecting from the first surface, the first surface divided into a first mating surface, a second mating surface and a third mating surface formed on the convex portion due to the convex portion, and the second surface defined as a fourth mating surface;

a plurality of conductive terminals retained in the insulative housing and defining a plurality of differential signal terminal pairs, grounding terminals and power terminals, each conductive terminal defining a contacting portion disposed on the mating surface, a retaining portion fixed to the base seat and a connecting portion extending outside of the base seat;

a first grounding bar connected to the front ends of the contacting portions the grounding terminals; and a second grounding bar connected to the retaining portions of the grounding terminals; wherein the first grounding bar and the second grounding bar are connected by a bridging portion thereof, the bridging portion defines a first arcuate portion and a second arcuate portion connected to each other and extending in an opposite manner in a vertical direction, a free end of the second arcuate portion abuts against the first grounding bar.

9. The electrical connector as described in claim 8, wherein the bridging portion is extending integrally from the second grounding bar.

10. The electrical connector as described in claim 9, wherein the first grounding bar and the second grounding bar are connected by at least two said bridging portions thereof.

11. The electrical connector as described in claim 8, wherein the power terminals are located on the second mating surface, the differential signal terminal pairs and grounding terminals are located on the first, third and fourth mating surfaces.

12. The electrical connector as described in claim 8, wherein the first grounding bar and the second grounding bar are arranged in the mating direction.

13. An electrical connector comprising:

an insulative housing having a base seat extending along a longitudinal direction, a mating portion extending forwardly from the base seat in a front-to-back direction perpendicular to said longitudinal direction;

a plurality of contacts disposed in the housing and categorized with signal contacts and grounding contacts, each of said contacts defining a front flat horizontal contact section exposed upon the mating portion, and a rear flat horizontal retaining section embedded within the base seat;

a first grounding bar extending along the longitudinal direction and rearwardly assembled into a first middle slot of the mating portion frame from a front side of the housing;

a second grounding bar extending along the longitudinal direction and forwardly assembled into a second middle slot of the base seat from a rear side of the housing; wherein the first grounding bar and the second grounding bar are essentially located at a same level, and the second grounding bar has a plurality of spring fingers extending in at least a vertical direction perpendicular to both said longitudinal direction and said front-to-back direction, to selectively mechanically and electrically connect to the retaining sections of the grounding contacts, respectively, and at least one spring tang extending in at least the front-to-back direction to mechanically and electrically connect to the first grounding bar; and wherein;

the first middle slot and the second middle slot do not communicate with each other in the front-to-back direction.

14. The electrical connector as claimed in claim 13, wherein each of said grounding contacts has a resilient spring tip section extending in at least the vertical direction to mechanically and electrically connect to the first grounding bar.

15. The electrical connector as claimed in claim 13, wherein each of said contacts further includes a connecting section located behind the rear retaining section and extending in at least in the vertical direction for mounting to a printed circuit board, and the connecting section of the grounding contact is narrower than that of the signal contact.

16. The electrical connector as claimed in claim 13, wherein said first grounding bar is essentially wholly a flat piece.

17. The electrical connector as claimed in claim 13, wherein the spring tang is located in front of the spring fingers in the front-to-back direction.

* * * * *